United States Patent [19]

Evans

[11] 4,318,431

[45] Mar. 9, 1982

[54] ELECTRONIC CONTROL SYSTEM FOR A POUCH PACKAGING MACHINE

[75] Inventor: Susan D. Evans, Stamford, Conn.

[73] Assignee: RJR Foods, Inc., San Francisco, Calif.

[21] Appl. No.: 214,388

[22] Filed: Dec. 8, 1980

[51] Int. Cl.[3] ..... B65B 3/04

[52] U.S. Cl. ..... 141/90; 141/91; 141/114; 141/166; 53/493; 222/70

[58] Field of Search ..... 141/10, 1, 114, 313–317, 141/129–192, 85–93, 98, 250–284; 53/493, 562, 407; 222/70

[56] References Cited

U.S. PATENT DOCUMENTS 2,649,674 8/1953 Bartlet ..... 53/562

4,081,942 4/1978 Johnson ..... 53/407

OTHER PUBLICATIONS

"Service Manual-Piston Filler", FMC Corporation (Ser. Nos. 08851300 and 579B50), see p. 5.

*Primary Examiner*—Houston S. Bell, Jr.

*Attorney, Agent, or Firm*—Grover M. Myers

[57] ABSTRACT

An electronic control system is described to control the operation of a positive displacement piston filler used for dispensing sauce or a suitable liquid into a flexible pouch which is controlled in movement by means of a Bartelt packaging machine. The electronic control system exerts control over the opening and closing of a dispensing plunger, a rotor valve and a product delivery piston associated with the sauce filler apparatus. A blow-off timing sequence is further controlled to assure that a blast of pressurized air enters the dispensing head of the sauce filler at the most optimum time to assure reliable cleaning of the top portion of the pouch prior to sealing. The control system employs separate timers which serve to enable control of each of the above described operations in one hundredths of a second to enable precise regulation of each phase of the fill cycle.

17 Claims, 6 Drawing Figures

TO ELECTRONIC TIMING & CONTROL LOGIC 50

36
DISPENSE PLUNGER
42
AIR SOURCE
35
38
34
40
30
29
21
20
FILLING LOCATION
22
24
25
27
31
ROTOR VALVE
PRODUCT PISTON
43
41
26
28
45
CRF2
44
34
32
LSSF
15
14
13
10
10
10
50
ELECTRONIC TIMING AND CONTROL LOGIC
TO BLOW-OFF VALVE 43
TO ROTOR VALVE 24
TO PRODUCT PISTON 31
TO DISPENSER PLUNGER 36
51
MANUAL ON-OFF CRST.

ELECTRONIC CONTROL SYSTEM FOR A POUCH PACKAGING MACHINE

BACKGROUND OF THE INVENTION

This invention relates to an electronic control system for use with apparatus for filling flexible pouches with a product.

The use of pouches which are fabricated from a flexible material such as a suitable plastic-foil laminate is well known in the art. In particular, this technique has been employed with food products and the canning industry is fully cognizant of many problems and solutions in regard to filling a pouch or container with food in a relatively automated procedure. In regard to this, there exists many patents which show and describe the typical problems involved in processing and packaging food in flexible pouches.

Perhaps one of the most well known machines for performing such an operation is the subject matter of U.S. Pat. No. 2,649,674 issued on Aug. 25, 1953 to H. L. Bartelt entitled "PACKAGING MACHINE". This machine has been employed extensively in the packaging industry. In this machine, the pouches are formed from a strip of material and the formed pouches are advanced through various filling stations where a product is introduced into the pouches. After product introduction by one or more filling stations, the pouches are advanced to other locations where steam may be introduced in order to remove air from the pouch and to enable the product to be packaged in an oxygen free environment to enable the product to possess a relatively long shelf life. The final operation requires sealing the pouch to thereby contain the final food product. The "BARTELT" machine, as indicated, is an extremely efficient and reliable apparatus and is described in detail in the above noted patent.

Patents such as U.S. Pat. No. 4,081,942 issued on Apr. 4, 1978 and entitled "MACHINE AND METHOD FOR FILLING, INTRODUCING STEAM INTO, AND SEALING FLEXIBLE POUCHES" assigned to the Rexham Corporation of New York as well as many other patents describe various additional apparatus which is employed in conjunction with such machines to increase the efficiency and provide desired operating characteristics.

In any event, depending upon the nature of the product which is being packaged, one experiences many different types of problems. In particular, such machines have been employed for packaging sauce type food products in pouches. It is a major desire of any packaging operation to fill the pouches or containers as rapidly as possible, while further assuring that the proper quantity of food is emplaced in each pouch. In conjunction with such desired operating characteristics, is the further problem of providing a good seal for such pouches when food materials such as liquids or sauces are introduced into the flexible pouches.

As is known in the art, the nature of the retort pouch is such that the seal qualtity is critical. Top seal acceptability is affected by the presence of blemishes from occluded drops of liquid. Such blemishes can occur from splattered sauce or condensed steam. In a sauce filling operation, the droplets of sauce which may effect the seal quality can be minimized by employing a properly timed blast of air at the dispenser tip. This is referred to in the art as blow-off. The prior art techniques for introducing sauce or a liquid into a retort pouch are cognizant of the problem and do employ a blow-off operation.

In any event, it has been a continuous problem in sauce filling operations to drive the equipment at high speed in order to fill as many pouches per minute as possible, and to further assure that when operation occurs at high speed, that the blow-off is implemented at the proper time in the cycle. Essentially, if blow-off occurs too early or too late in the cycle, its effectiveness is substantially reduced.

In prior art sauce filling operations, a useful mechanism which is available has been referred to as the RAQUE filler. The Raque filler apparatus is located at a filling station location associated with a Bartelt machine. The filler employs a hopper which contains a sauce. The sauce is retracted from the hopper through a rotor valve by means of a product piston and eventually dispensed by means of a dispensing piston. The Raque filler is controlled in operation by a completely pneumatic system. Essentially, the control system uses pressurized air to perform all logic operations. Air logic has been widely employed in conjunction with packaging operations and has been extensively used with the Raque filler.

There are many disadvantages in regard to using air logic in food processing and especially where a liquid as a sauce is being dispensed. As one can imagine, impurities in the air can jam filters and mufflers associated with such systems, thus causing many failures and reductions in air pressure. Apart from these considerations is the fact that air logic operates at relatively slow speeds which are a function of the velocity of a sound pressure wave. Accordingly, the systems do not permit rapid pouch filling operations and are difficult to control in regaard to timing and operation.

By employing an electronic system, one can achieve more rapid operation and relative immunity from many problems associated with air logic. However, electronic control of such apparatus is also extremely difficult to implement due to the fact that the packing machine such as the Bartelt machine is not synchronized to the operation of the filling station and if one desires to achieve more rapid operation, one has to be assured that the entire filling sequence will occur within a predetermined interval and must occur according to the operating characteristics of the packaging machine.

In order to accomplish electronic control, the apparatus must be capable of directly inferfacing with existing packaging machines to assure reliable and optimum operation. Hence, it is a general aim of the present invention to provide a new and improved electronic control system to be used in conjunction with a pouch packaging machine and which system is adapted to control the operation of a sauce filler apparatus to provide a system capable of filling pouches with sauces or liquids at relatively high rates.

A further object of the present system is to optimumly control blow-off during a filling cycle to assure an acceptable seal quality for the pouch.

BRIEF DESCRIPTION OF THE INVENTION

The invention is a sauce filler control apparatus for controlling the sequence of operation of a filling apparatus having product means for receiving and expelling the material to be dispensed, dispensing means for depositing the remaining material, valve means selectively connecting the product means with a material source when the valve is in a fill position and with the dispensing means when the valve is in a dispensing position, and actuating means responsive to electrical signals for controlling the product means, dispensing means and valve means. The control apparatus comprises a first timing means responsive to an initiating electrical signal for providing a first electrical signal at the end of a first time interval following receipt of the initiating signal; a first circuit means for supplying the first signal to the actuating means to cause the product means to assume its receiving position, a second timing means responsive to the first signal for providing a second electrical signal at the end of a second time interval following receipt of the first signal; a second circuit means for supplying the second signal to the actuating means to cause the valve means to assume its dispensing position; trigger circuit means responsive to the second signal and an externally supplied signal for supplying a triggering signal to cause said dispensing means to open to a receiving position; a third timing means responsive to the triggering signal for providing a third electrical signal at the end of a third time interval following receipt of the triggering signal; a third circuit means for supplying the third signal to the actuating means to cause said product means to assume its expelling position; a fourth timing means responsive to the third signal for providing a fourth electrical signal and a reset electrical signal to reset all of the timing means at the end of a fourth time interval following receipt of the third signal; a fourth circuit means for supplying the fourth signal to the actuating means to cause the dispensing means to assume a non-receiving position and to cause the valve means to assume its fill position and to the first timing means as the initiating signal.

BRIEF DESCRIPTION OF THE DRAWINGS

Above-mentioned and other features and objects of this invention will become more apparent by reference to the following description taken in conjunction with the accompanying drawings, in which.

DETAILED DESCRIPTION OF THE INVENTION

Figure 1:
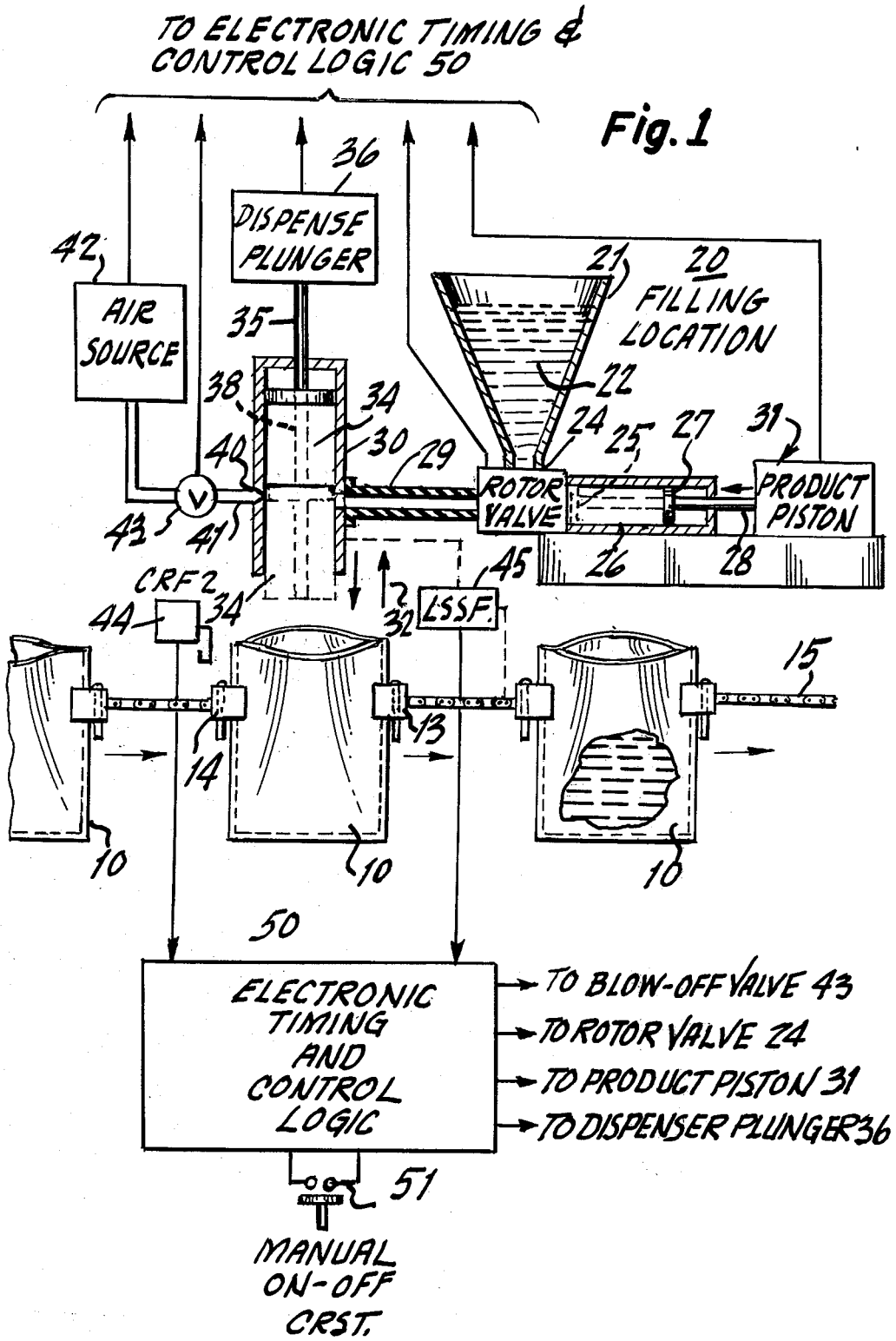
FIG. 1 is a partial perspective and schematic view of a pouch packaging machine employing an electronic control system for a sauce filling operation.

Shown in the drawings for purposes of illustration, the invention is embodied in a packaging machine for forming filling and sealing pouch packages such as 10. The pouch 10 is usually made from a single or composite sheet of flexible material such as a suitable plastic as a polyolefin which may contain a middle laminate of aluminum foil with an outer laminate of a polyester. The fabrication and composition of pouches as 10 are extremely well known in the field.

The pouch 10 may be fabricated during the operation of the packaging machine. In most respects, the packaging machine is similar in construction to that machine disclosed in U.S. Pat. No. 2,649,674 (Bartelt) and thus certain elements of the machine will not be described in detail as one can ascertain the complete operation of the packaging machine by reference to the cited patent.

As indicated in FIG. 1, it is sufficient to state that each pouch 10 is adapted to be gripped releasably at its side margins by leading and trailing clamps 13 and 14 which are carried on a chain conveyor 15. The chain conveyor 15 is adapted to be advanced by a suitable drive mechanism as explained in the above noted patent. As the chain 15 is advanced, the pouches 10 are moved into and momentarily dwell at a series of horizontally spaced stations where packaging operations as filling, steaming and sealing are performed on the pouches. In the present instance, the pouches 10 are advanced in spaced edgewiwse relation and are held with their open ends facing upwardly.

Located above the central pouch 10 is a sauce filler location 20. The sauce filler is a well known Raque filler whose operation is fully known to those skilled in the art and which will be briefly described herein.

Figure 4A:
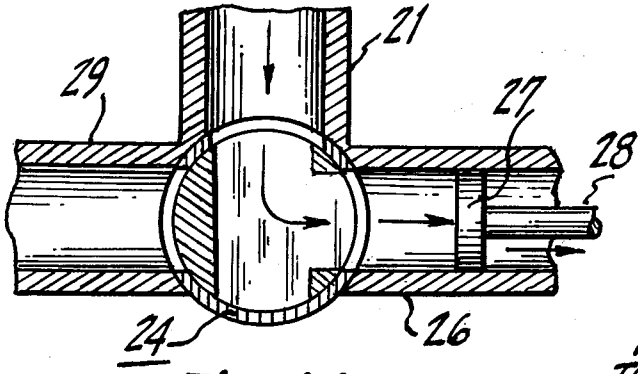
FIG. 4A is a detailed schematic drawing of the rotor valve shown in FIG. 1 in its fill position.
Figure 4B:
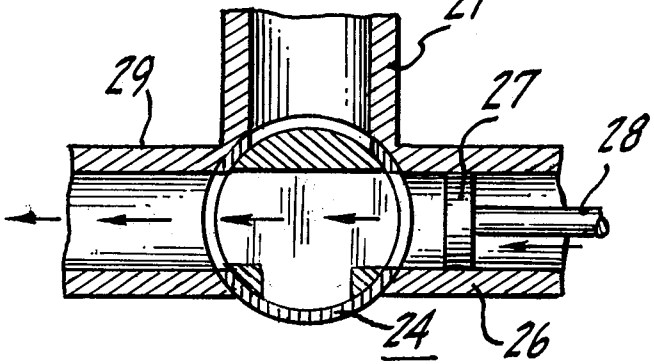
FIG. 4B is a detailed schematic drawing of the rotor valve shown in FIG. 1 in its dispensing position.

There is shown a main hopper 21 which acts as a reservoir for a liquid or sauce 22. The hopper 21 is of a truncated cone configuration having a narrow bottom portion directed into a rotor valve 24. The rotor valve 24 is shown in detail in FIG. 4A and FIG. 4B. The rotor valve, when rotated to a fill position, shown in FIG. 4A will enable communication between the hopper 21 and a product cylinder 26. When rotated to a dispensing position shown in FIG. 4B the rotor valve enables communication between the product cylinder 26 and a dispensing tube 29. The rotor valve 24, as above described, has the inlet, outlet and fill apertures arranged in a "T" configuration. As indicated, such valves are well known in the art. In the present invention the positional control of the valve is afforded by a stepper motor or coil, which upon reception of a suitable biasing signal, will actuate a valve to admit pressurized air to the Raque-supplied air motor to move the valve into any one of its operating positions.

Shown coupled to the inlet port **24*a* of the rotor valve 24 is the product cylinder 26 having located therein a product piston 27. The piston 27 is coupled to a piston rod 28 and is controlled by the product piston solenoid and associated valve and air motor 31. As is known, the piston 27 can be in a retracted receiving position as shown or in an extending expelling position (shown in dashed lines). The piston 27 will traverse from the extended to the retracted position upon application of a suitable potential to the solenoid 30**.

Coupled to the outlet port of the rotor valve 24 is the dispensing tube 29. The tube 29 is fabricated from a flexible hose material and provides an output path for receiving product, as the sauce from the product dispensing cylinder 26, as will be described.

The dispensing tube 29 is coupled to an input port of a dispensing head 30. The dispensing head 30 is part of the Raque sauce filler. Accordingly the dispensing head is controlled to move in the vertical direction as indicated by arrows 32. When the dispensing head 30 is moved downwardly, the opened bottom end 34 moves into the open top of the pouch 10. As indicated above, the vertical movement of the dispensing head is strictly under control of the packaging machine through a cam shaft and cam follower as described in the above noted patent.

Figure 5:
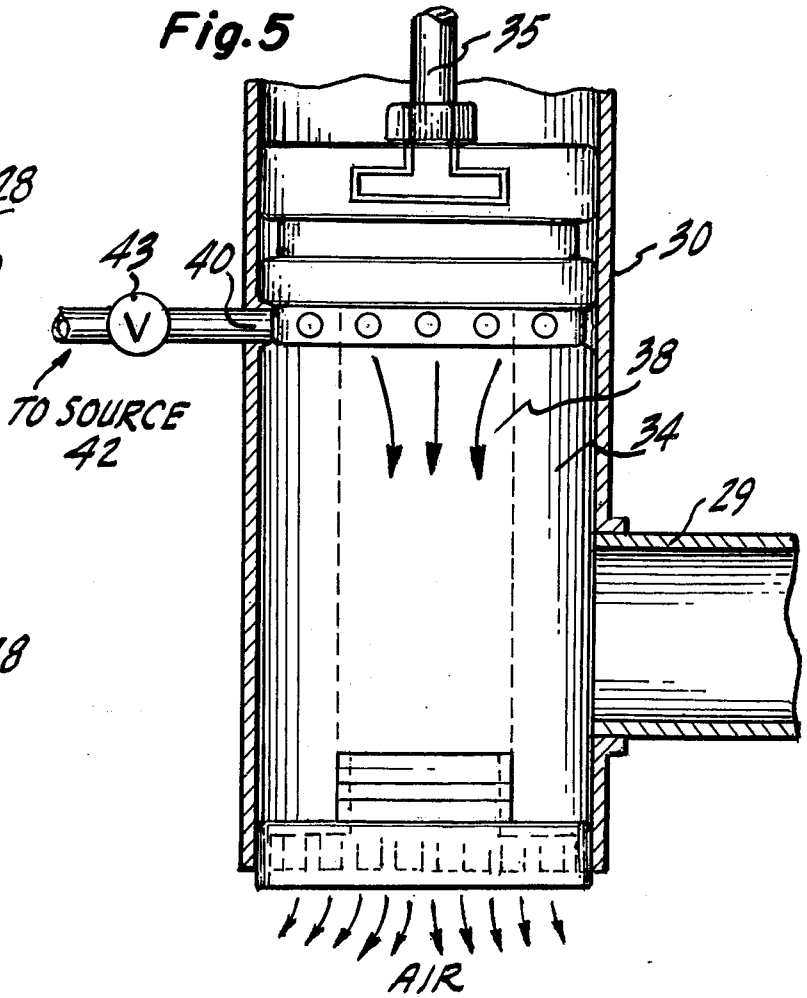
FIG. 5 is a detailed schematic drawing of the dispensing plunger shown in FIG. 1 in its non-receiving, or dispensing position.

Located within the dispensing head is a dispensing plunger 34, shown in detail in FIG. 5. The plunger 34 is coupled via a suitable rod 35 to a solenoid coil and an associated valve and air motor 36 referenced as dispense plunger. The dispensing plunger 34 has a central aperture 38 through which a blast of pressurized air is directed during a blow-off procedure, as will be explained.

Located in a sidewall of the dispensing head 30 is an inlet aperture 40 which is coupled via a flexible hose 41 to a source of pressurized air 42. A valve 43 under the control of the electronic system to be described provides the timing for the blow-off operation and hence, determines the duration of the opening of the valve 43, as will be described.

Shown located to the left of the central pouch 10 is a proximity switch 44 also designated as CRF-2. As will be described, this switch may be a microswitch and is activated by a pouch which enters the area at which the dispensing head 30 is located. The switch 44 serves to aid in controlling the sequence of operations to be described.

A further switch 45 designated as LSSF is also shown. The switch 45 is a limit switch and is operated from the main cam shaft of the Bartelt machine and operates in relation to the speed of the machine to provide a limit operation indicative of a pouch being within the filling station area. This switch, as will be further described, also controls the sequence of operations to be performed by the electronic timing and control logic.

As seen from FIG. 1, both switches 44 and 45 interface with the electronic timing and control logic module 50. As will be explained, the module 50 provides an output which controls the blow-off time via valve 43, provides an output which controls the rotor valve 24, provides a further output which controls the product piston solenoid 31 and the dispenser plunger solenoid 36.

Also depicted in FIG. 1 is a manual switch 51 designated as on-off or CRST. In order to provide the timing and control sequence, the switch 51 is in its closed position during system operation.

With the above general description of the apparatus in mind, it is believed that an explanation of the basic sequence involved is warranted.

As one can ascertain, it is an object of the filling operation to insert a predetermined amount of sauce or liquid 22 into the pouch 10. In order to do so the following minimum operations must occur:

The product cylinder, at a suitable time in the sequence, must be loaded with product through the rotor valve. The product piston 27, discharges the product from the product cylinder 26. When the rotor valve 24 is properly positioned, the product piston 27 moves to its extended position to push or force the product charge into the output dispensing tube 27 and thus into the dispensing head 30. At this time, the bottom of the dispensing head 30 is within the pouch 10. The dispensing plunger now operates to move to its dashed line position to push the remainder of the product charge into the pouch. When the dispensing plunger is moved to the dashed line position, (shown in detail in FIG. 5) the tube 29 to head 30 is blocked. The blow-off valve is operated and a blast of air is directed into the dispensing head via aperture 40. The blast is directed through aperture 38 and serves to force any remaining liquid droplets to be directed into the pouch.

The above described operation occurs when the pouch is positioned below the dispensing head and the operation is repeated, as will be described, for each pouch carried by the chain conveyor system associated with the Bartelt machine.

Figure 2:
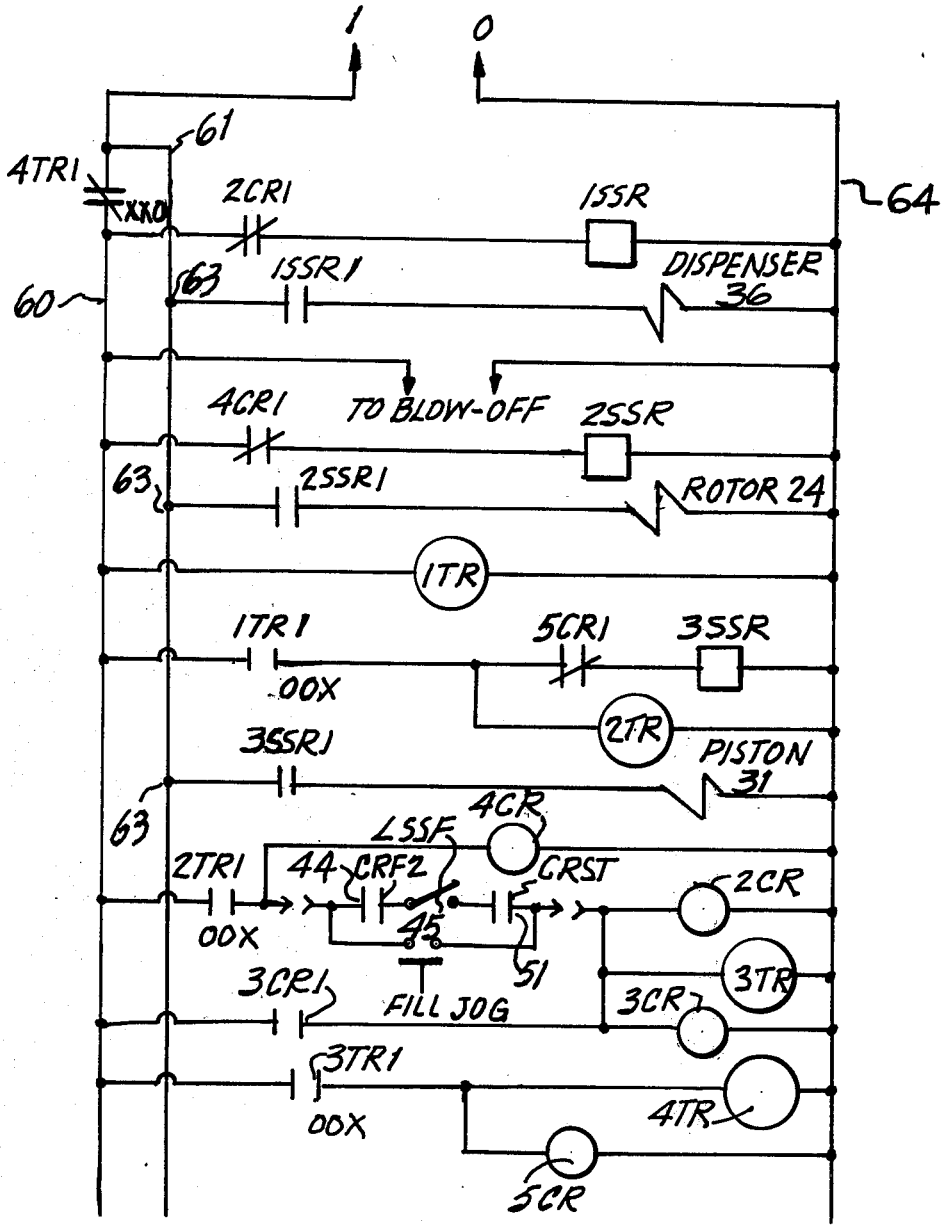
FIG. 2 is an electrical schematic diagram of the electronic timing and control logic according to this invention.

Referring to FIG. 2, there is shown an electrical schematic diagram of the electronic timing and control logic 50 depicted in FIG. 1. Where applicable, similar reference numerals have been retained to designate similar functioning parts.

In the schematic, two parallel lines represent a normally opened contact, while two parallel lines with a transverse line drawn through represent a normally closed contact.

The symbols for indicating a relay coil are nCR, where N is a positive integer. A contact associated with that coil is designated as nCRx, where x is a positive integer. A solid state relay is indicated as nSSR with a contact of that relay indicated as NSSRx. A timer is depicted as nTR with a contact of the timer indicated as nTRx. Thus, in referring to FIG. 2, the top solid state relay is designated as 1SSR as compared to 2SSR and 3SSR. A contact relay 1SSR is designated as 1SSR1 and is normally opened. In the embodiment described, it will be assumed that the machine advances the pouches from station to station once each second.

As can be seen from FIG. 2, 1SSR is in series with contact 2CR1 which is normally closed and which is associated with relay coil 2CR. A timer 1TR is depicted by a circle and its contact is designated as 1TR1. Next to this contact is a designation 00x. Since contact 1TR1 is controlled by the timer 1TR, the designation 00x is determined as follows: Contact 1TR 1 is a normally opened contact and hence, the first 0 indicates this. When the timer is running, the second 0 indicates that the contact is also normally opened. When the timer runs out, the contact is closed and hence, the third symbol being x represents contact closure. This terminology is used beneath each contact which is timer controlled.

The above noted nomenclature has been employed in lieu of numbers to enable one to clearly follow the system operation, which otherwise would be extremely difficult.

As seen from FIG. 2, the control coils for the dispenser plunger solenoid 36, the rotor valve 24 and the product piston 31 are depicted by a resistor notation. It is indicated at the on set that based on the well known operation of such components, one skilled in the art will understand from this circuit and control diagram how these mechanical components are, in fact, reliably and accurately controlled by the electronic circuitry to be described.

In order to clarify operating procedure, the function of the electronic circuitry depicted in FIG. 2 will be described in conjunction with the mechanical components depicted in FIG. 1 so that there is a complete understanding of the system operation and control.

We will assume for present purposes that all power is off and the packaging machine is not operating. Under these conditions, the dispensing plunger 36 is in the up position, the rotor valve 24 is in the dispensing position, and the product piston 30 is in the extended, expel position (dashed). Now assume that power is applied.

In FIG. 2, a voltage appears between terminals 1 and 0. This voltage causes the following action to occur:

Power is applied from the 1 terminal through the normally closed contact 4TR1 (xx0). The power through this contact is directed via line 60 to the various circuit components. Line 61 is obtained above contact 4TR1 and is directed to terminals 63. The 0 side of the power line is directed to line 64 which provides terminal power to one side of all circuit components.

Thus, as can be seen from FIG. 2, the piston solenoid 31 is in series with contact 3SSR1 between terminals 64 and 63. In the same manner, the rotor coil 24 is in series with contact 2SSR1 between terminals 64 and 63 as is the dispenser coil 36 which is in series with contact 1SSR1. All other components are in series between terminals 64 and 60 through contact 4TR1.

When power is applied, switch 51 which is the on/off switch CRST is manually closed and remains closed during the entire operating sequence.

From FIG. 2, it is immediately seen that solid state relay 1SSR operates through the normally closed contact 2CR1. This closes contact 1SSR1 which causes the dispensing plunger 36 to operate. The dispensing plunger 36 operates to the discharge position shown in dashed lines in FIG. 1. Due to the fact that 4CR1 is closed, then solid state relay 2SSR is also operated. The operation of this relay closes contact 2SSR1 which is in series with the rotor coil 24. This causes the rotor to move to its fill position.

The timer 1TR operates as soon as power is supplied. The timer may be a solid state timer which is available from many manufacturers and provides a time out sequence of one hundred milliseconds or 0.1 seconds. Essentially, the timer 1TR allows the rotor valve to turn to its fill position and allows the dispensing plunger 36 to move to its down position. When the timer 1TR runs out, contact 1TR1 closes. This activates 3SSR via contact 5CR1 and 1TR1 and activates a second timer 2TR. Upon activation of 3SSR, contact 3SSR1 closes. This moves the product piston 27 to its retracted, receiving position. When piston 27 moves to the retract position, it draws the product charge from the hopper 21 into the product cylinder 26 through the rotor valve 24. The time 2TR is set for 0.18 seconds which assures that the product piston 27 retracts and hence, draws a proper charge into the cylinder 26. At the end of the time out afforded by 2TR, contact 2TR1 closes. This immediately activates relay 4CR which opens contact 4CR1 to deactivate relay 2SSR and hence, opens contact 2SSR1 which in turn causes the rotor valve to move to the dispensing position.

In the meantime, the pouches 10 are moving during the above described operation, but as one can ascertain, the product cylinder 26 has a complete product charge and the rotor is in the dispensing position. At this point in time, a pouch which is being moved by the conveyor belt will activate the proximity switch CRF-2. The switch LSSF is then activated by the Bartelt machine which is a completely normal condition and hence, both CRF-2 and LSSF are closed. The closure of LSSF is a momentary closure and occurs when the dispensing head is being moved downwardly to indicate that a pouch is in the position to be filled. The Bartelt machine provides this indication.

In any event, as soon as switch LSSF closes, relay coil 3CR receives power through the series switches CRST, LSSF, CRF-2 and 2TR1 which is closed due to the time out of 2TR. Relay 3CR latches through its own contact 3CR1. This immediately activates timer 3TR to begin a new timing mode. When LSSF is operated, the machine has moved the dispensing head 30 down and its bottom end is within the pouch 10. As this occurs, switch LSSF is opened by the Bartelt machine.

Relay coil 2CR also operates when the above connection is made. This opens contact 2CR1 and hence, deactivates 1SSR. The deactivation of 1SSR opens contact 1SSR1 which causes the dispensing plunger 36 to move to its receiving position, opening the inlet to the tube 29. The timer 3TR, as operating, allows enough time to assure that the dispensing plunger is moved up. The circuitry carrying the signal from the machine activates the timer 3TR and in effect acts as a trigger circuit to coordinate the filler with the Bartelt machine operation.

As can be seen, during the above procedure, the rotor valve remains in the dispensing position.

3TR has a timing cycle which permits it to run for approximately 0.23 seconds. When it times out, contact 3TR1 closes, thus activating timer 4TR and relay coil 5CR. When 5CR is energized, relay 3SSR opens causing the product piston 27 to extend to thus push product into the dispensing tube 29 via the rotor valve 24, and into the pouch through the dispensing head 30. When 4TR times out, contact 4TR1 in series with line 60 opens, which automatically resets all timers as 1TR, 2TR, 3TR and 4TR by removing power from the source.

Also shown across contacts CRF-2, LSSF and CRST is a switch designated as fill jog. As one can ascertain, if this switch is manually operated, it will bypass the functions implemented by the closure of CRF-2 and LSSF and hence, an operator, by the manual opening and closing of the fill jog switch, can dispense a charge of product into the pouch. In a manual mode, this feature may be necessary due to a system failure or for low speed production.

4TR resets all timers including itself and hence, power is again applied to the circuit which immediately causes the above noted sequence to start all over again as above described.

As indicated during the first step, which is analogous to power coming on by the closure of contact 4TR1 again, the following sequence occurs:

The solid state relay 1SSR is energized and closes contact 1SSR1 which moves the dispensing plunger in the down direction. That closes the entrance to the dispensing head 30 and deposits the remaining sauce into the pouch. As seen from FIG. 1, when the dispensing plunger is in the dashed line position, the dispensing head 30 is within the pouch 10 by the action of the Bartelt machine. When the dispensing plunger is in the down position, blow-off should occur to obtain optimum removal of the droplets of liquid.

Figure 3:
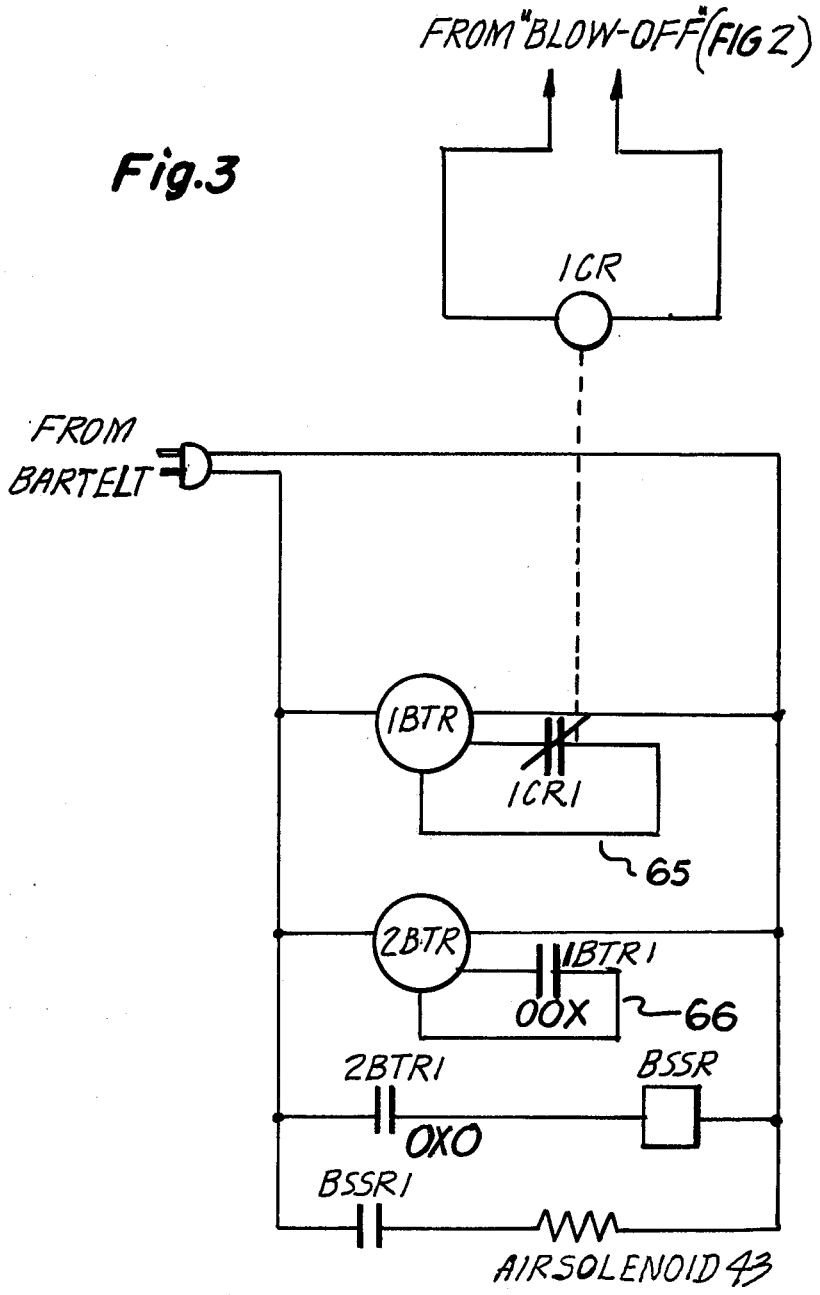
FIG. 3 is a schematic diagram of a blow-off control circuit according to this invention.

In order to exactly control the blow-off sequence, the signal labelled blow-off of FIG. 2 is shown in FIG. 3. When 4TR times out and opens 4TR1, the relay 1CR is deenergized. That closes normally closed contact 1CR1 which begins the timer 1BTR running by closing the separately energized 24 V DC circuit 65. This timer 1BTR essentially runs in parallel with timer 1TR and blow-off does not begins until timer 1BTR times out, which is manifested by an adjustable delay time between timer 1TR and 1BTR, to give the dispensing plunger time to descend. As soon as timer 1BTR times out, contact 1BTR1 closes and closes the separately energized 24 V DC circuit 66, upon which timer 2BTR begins to time out. As soon as timer 2BTR begins to run to commence timing out, contact 2BTR1 closes which activates the solid state relay BSSR. The activation of solid state relay BSSR closes contact BSSR1 and activates the air solenoid 43 to allow a blast of air to be directed through the aperture 38 within the dispensing plunger 34. This immediately causes a blast of air to be directed through the aperture 38 when the dispensing plunger is in the down position.

Thus, in the interval before 2BTR times out, a blast of air is directed into the dispensing head and through the aperture in the dispensing plunger, as shown in FIG. 5. As soon as 2BTR times out, blow-off is discontinued and the air solenoid 43 is deactivated. The timers 1BTR and 2BTR enable control of blow-off within a tolerance of one hundredth of a second. This is adjustable by adjusting the time out of 1BTR and 2BTR. Hence, blow-off is extremely accurate and one is thus assured that blow-off occurs at the proper time in the cycle.

The above described electronic control system enables operation of a Raque sauce filler in conjunction with a packaging machine of the Bartelt type by employing four separate and distinct timing sequences, each of which is separately controlled. In this manner, control is exerted over each of three operations which are the operations of the dispensing plunger 34, the rotor valve 24 and the product delivery piston 27. The use of the timers enables calibration in one hundredths of a second to therefore afford the ability to exactly control each phase of the fill operation. The electronic circuitry is relatively immune to sauce splash as it is separately housed. The operation is extremely rapid and production runs on existing machines employing this circuit have increased filling capacity by two or more times. As indicated, the electronics are completely compatible with existing packaging machine wiring and are extremely simple to construct and implement in conjunction with such machines.

The typical types of products which are dispensed in accordance with the sauce filler during a packaging operation are sauces for beef stew, chicken creole and various other sauces which are relatively viscous. The unit operates completely reliably in conjunction with the packaging machine due to the fact that operation of each phase of the sauce filler is controlled within extremely stringent time limits. As indicated, this feature is important due to the fact that the Bartelt packaging machine separately controls the operation of the dispensing head 30 and the switch LSSF which therefore dictates that these critical components are not within the control of the electronic timing and control logic. It is therefore imperative that the above described operations occur within the limits imposed by these components.

Hence, by using the control system above described, one can assure that a sauce product charge of proper weight is always introduced into a pouch at the maximum speed of pouch operation, which is strictly limited by the inherent speed of operation of the Bartelt machine. The advantage of this control system manifests itself in that the filler can now operate at maximum speed due to the precise regulation and control over the filling operations. Such operation could not be achieved by the use of air logic which undesirably limits the speed of operation and further was associated with the above described problems.

What is claimed is:

1. A filler control apparatus for controlling the sequence of operation of a filling apparatus having product means for receiving and expelling the material to be dispensed, dispensing means for depositing the material, valve means selectively connecting said product means with a material source when said valve is in a fill position, or with said dispensing means when said valve is in a dispensing position, and actuating means responsive to electrical signals for controlling said product means, said dispensing means and said valve means, the control apparatus comprising:

a first timing means responsive to an initiating electrical signal for providing a first electrical signal at the end of a first predetermined time period following receipt of said initiating electrical signal;

first circuit means for supplying said first electrical signal to said actuating means to cause said product means to move to its receiving position;

a second timing means responsive to said first electrical signal for providing a second electrical signal at the end of a second predetermined time period following receipt of said first electrical signal;

second circuit means for supplying said second electrical signal to said actuating means to cause said valve means to move to its dispensing position;

trigger circuit means responsive to said second electrical signal and to an externally controlled switching means for providing a triggering electrical signal to cause said dispensing means to open to a receiving position;

a third timing means responsive to said triggering electrical signal for providing a third electrical signal at the end of a third predetermined time period following receipt of said triggering electrical signal;

third circuit means for supplying said third electrical signal to said actuating means to cause said product means to expel the material;

a fourth timing means responsive to said third electrical signal for providing a fourth electrical signal and for providing a reset electrical signal to reset said first, second, third and fourth timing means at the end of a fourth predetermined time period following receipt of said third electrical signal; and fourth circuit means for supplying said fourth electrical signal to said actuating means to cause said dispensing means to assume a non-receiving position and to cause said valve means to assume said fill position and to said first timing means as said initiating signal.

2. A filler apparatus, for use with a machine to supply containers to be filled with material and to provide the external switching means, including the filler control apparatus recited in claim 1, and further including:

product means moveable between receiving and expelling positions for receiving thereinto and expelling therefrom the material to be dispensed into the containers;

dispensing means moveable between a receiving position for receiving the material thereinto and a non-receiving position for discharging the material therefrom; and valve means moveable between fill and dispensing positions to selectively connect said product means with a material source when said valve means is in said fill position and with said dispensing means when said valve means is in said dispensing position.

3. The apparatus recited in claim 2 wherein:

said product means comprises a product piston moveable within a product cylinder;

said dispensing means comprises a dispensing plunger moveable within a cylindrical dispensing head and a dispensing tube with a first end in communication with said dispensing head and a second end; and said valve means comprises a rotary valve having a housing with a first port communicating with said material source, a second port communicating with said product cylinder and a third port communicating with said second end of said dispensing tube, and a rotary element rotatable within said housing for selectively placing said first port in communication with said second port when in said fill position and said second port in communication with said third port when in said dispensing position.

4. The apparatus recited in claim 3 further including:

product piston actuating means for moving said product piston in response to an electrical signal;

dispensing plunger actuating means for moving said product piston in response to an electrical signal; and rotary element actuating means for rotating said element in response to an electrical signal.

5. A machine for filling containers open at one end and having a filling station with the apparatus recited in claim 4 disposed at said filling station, said machine including:

means for advancing a container through said filling station;

means for lowering said dispensing head into the container disposed at said filling station;

limit switch means comprising said external switching means for controlling said switching means in response to the location of a preselected machine element; and means for supplying power to said control apparatus.

6. The machine recited in claim 5 wherein said external switching means further comprises proximity switch means for sensing the presence of a container in said filling station and preventing the supply of said triggering signal to said control apparatus unless a container is sensed.

7. The apparatus recited in claim 6 wherein said containers are pouches and are advanced intermittently through said machine at a rate of one per second and said first predetermined time period is 0.10 second, and second predetermined time period is 0.18 second, said third predetermined time period is 0.23 second and said fourth predetermined time period is 0.15 second.

8. The apparatus recited in claim 1, 2, 3, 4, 5, 6 or 7 wherein said dispensing means further includes blow-off means for providing a blast of air through said dispending means to insure removal of the material from said dispensing means, said blow-off means comprising:

a first blow-off timing means responsive to said reset electrical signal for providing a first blow-off electrical signal at the end of a predetermined delay following receipt of said reset electrical signal;

blow-off valve means for selectively providing and breaking communication between a source of pressurized air and said dispensing means;

blow-off valve actuating means for controlling said blow-off valve means;

first blow-off circuit means for supplying said first blow-off electrical signal to said blow-off valve relay means to establish communication between said air source and said dispensing means;

a second blow-off timing means responsive to said first blow-off electrical signal for providing a second blow-off electrical signal at the end of a predetermined blow-off time period following receipt of said first blow-off electrical signal, wherein said delay and blow-off time periods do not in total exceed said first and second predetermined time periods;

second blow-off circuit means for supplying said second blow-off electrical signal to said blow-off valve relay means to break communication between said air source and said dispensing means; and interface connecting means for supplying said reset electrical signal to said blow-off means for supplying said fourth electrical signal to said blow-off means to reset said blow-off timing means.

9. The apparatus recited in claim 8 wherein said blow-off means further comprises a port in said dispensing head, an annular passage in said dispensing plunger for communicating with said port when said dispensing plunger is in said discharge position and an axial passage opening at the end of said dispensing plunger in communication with said annular passage.

10. A filler control apparatus as recited in claim 1, 2, 3, 4, 5 or 6 wherein said circuit means comprises:

four timed relays, each associated with one of said timing means, which timed relays are of the type that open or close a circuit when said associated timing means is set, running in response to an electrical current and timed out wherein said timing means are of the type that begin running when an electrical current is supplied thereto and reset after timing out when electrical current to them is discontinued; and a plurality of relays each having associated therewith a contact of the type that is in an open or closed mode when an electrical current is supplied to the relay and in the opposite mode when an electrical current is discontinued.

11. The apparatus recited in claim 10 wherein said actuating means comprise solenoid actuators.

12. The apparatus recited in claim 11 wherein said first, second and third timed relays are open-open-closed and said fourth timed relay is closed-closed-open, said relays include three normally open solid state relays and three normally closed and are normally open control relays, said product piston is normally in said expelling position and moves to said receiving position when said product piston solenoid is energized, said dispensing plunger is normally in said receiving position and moves to said discharging position when said dispensing plunger solenoid is energized, and said rotary element is normally in said dispensing position and moves to said fill position when said rotary element solenoid is energized, the apparatus further comprising:

a first terminal for applying power connected to a first side of said fourth timed relay;

a first circuit path having a first normally closed control relay contact in series with a first solid state relay connected across the second side of said fourth timed relay and a second terminal for applying power;

a second circuit path having a second normally closed control relay contact in series with a second solid state relay, said second circuit path being connected in parallel with said first circuit path;

a third circuit path including said first timing means connected in parallel with said first circuit path;

a fourth circuit path including said first timed relay connected in series with a third normally closed control relay and a third solid state relay, said fourth circuit path connected in parallel with said first circuit path;

a fifth circuit path including said second timing means connected in parallel with said third normally closed control relay and said third solid state relay;

a sixth circuit path including said second timed relay connected in series with said externally controlled switching means and said first control relay, said sixth circuit path connected in parallel with said first circuit path;

a seventh circuit path including said second control relay connected in parallel with said externally controlled switching means and said first control relay;

an eighth circuit path including a fourth normally open control relay contact connected in series with said fourth control relay, said eighth circuit path connected in parallel with said first circuit path;

a ninth circuit path including said third timing means connected in parallel with said first control relay and said third control relay;

a tenth circuit path including said third timed relay connected in series with said fourth timing means, said tenth circuit path connected in parallel with said first circuit path;

an eleventh circuit path including said third control relay connected in parallel with said fourth timing means;

a twelfth circuit path including a first solid state relay contact connected in series with said dispensing plunger solenoid, said twelfth circuit path connected across said terminals for applying power;

a thirteenth circuit path including a second solid state relay contact connected in series with said rotary element solenoid, said thirteenth circuit path connected in parallel with said twelfth circuit path, and a fourteenth circuit path including a third solid state relay contact connected in series with said product piston solenoid, said fourteenth circuit path connected in parallel with said twelfth circuit path.

13. The apparatus recited in claim 12 further including said externally controlled switching means connected in series in said sixth circuit path which means comprises a proximity switch that closes when it senses the presence of a container to be filled connected in series with a limit switch that closes at a predetermined time during the presence of a container to be filled.

14. The apparatus recited in claim 13 wherein said externally controlled switching means includes an on-off switch in series with said proximity switch and said limit switch.

15. The apparatus recited in claim 14 wherein said externally controlled switching means includes a fill-jog switch, connected in parallel with said proximity switch, said limit switch and said on-off switch, for manually closing said switching means.

16. The apparatus recited in claim 12 further including blow-off control means for providing a blast of air through said dispensing plunger, said blow-off control means comprising:

a blow-off interface circuit path comprising a blow-off control relay connected in parallel with said first circuit path;

a first blow-off circuit path including a first blow-off timing means connected across terminals for supplying power;

a normally closed blow-off control relay in a separately energized circuit for supplying power to start said first blow-off timing means when said blow-off control relay is closed;

a second blow-off circuit path including a second blow-off timing means connected in parallel with said first blow-off circuit path;

a first blow-off timed relay of the open-open-closed type in a separately energized circuit for supplying power to said second blow-off timing means when said first blow-off timed relay is closed;

a third blow-off circuit path including a second blow-off timed relay of the open-closed-open type connected in series with a blow-off solid state relay, said third blow-off circuit path connected in parallel with said first blow-off circuit path;

a fourth blow-off circuit path including a normally open blow-off solid state relay contact connected in series with a blow-off solenoid for providing communication between said blow-off means and a source of pressurized air when said blow-off solenoid is energized, said fourth blow-off circuit path connected in parallel with said first blow-off circuit path.

17. The apparatus recited in claim 16 further including blow-off means comprising:

a port in said dispensing head, an annular passage in said dispensing plunger for communicating with said port when said dispensing plunger is in said discharge position;

an axial passage opening at the end of said dispensing plunger in communication with said annular passage;

blow-off valve means for selectively connecting said port to a source of pressurized air; and a blow-off solenoid for operating said blow-off valve.

* * * * *